US006830163B2

(12) United States Patent
Petit

(10) Patent No.: US 6,830,163 B2
(45) Date of Patent: Dec. 14, 2004

(54) FLUID DISPENSER PUMP

(75) Inventor: Ludovic Petit, Vitot (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/414,295

(22) Filed: Apr. 16, 2003

(65) Prior Publication Data

US 2004/0011821 A1 Jan. 22, 2004

Related U.S. Application Data

(60) Provisional application No. 60/387,431, filed on Jun. 11, 2002.

(30) Foreign Application Priority Data

Apr. 17, 2002 (FR) ..... 02 04811

(51) Int. Cl.[7] ..... B65D 88/54
(52) U.S. Cl. ..... 222/321.7; 222/321.9
(58) Field of Search ..... 222/321.7, 321.9, 222/383.1, 385, 341, 402.1, 402.2

(56) References Cited

U.S. PATENT DOCUMENTS 4,930,999 A * 6/1990 Brunet et al. ..... 417/552
4,964,547 A * 10/1990 Lina ..... 222/385
5,083,682 A * 1/1992 Cater ..... 222/321.2
5,147,073 A * 9/1992 Cater ..... 222/321.9
5,190,192 A * 3/1993 Lina et al. ..... 222/321.2
5,207,659 A 5/1993 Pennaneac'h et al.
5,992,704 A * 11/1999 Jager-Waldau ..... 222/341

FOREIGN PATENT DOCUMENTS

EP 0 346 167 A 12/1989
EP 0346167 A1 * 12/1989 ..... B05B/11/00
EP 0499073 A1 * 8/1992 ..... B05B/11/00
EP 0790079 A2 * 8/1997 ..... B05B/11/00
EP 0953381 A2 * 3/1999 ..... B05B/11/00
EP 1136135 A2 * 9/2001 ..... B05B/11/00

* cited by examiner

*Primary Examiner*—Gene Mancene
*Assistant Examiner*—Frederick C. Nicolas
(74) *Attorney, Agent, or Firm*—Sughrue Mion, PLLC

(57) ABSTRACT

A manually-actuated fluid dispenser pump including a pump body (10) and a piston (50) mounted to slide in leaktight manner in the pump body (10) between a rest position and a dispensing position, the piston (50) being provided with at least a bottom sealing lip (51) in leaktight contact with the pump body (10), the pump body (10) being provided with an inwardly-extending radial shoulder (11) co-operating with the bottom lip (51) of the piston (50) to form an abutment for the piston (50), and to define its dispensing position, the pump being characterized in that the pump body (10) is provided with an axial annular setback (15) at the radial shoulder (11) so that the active sealing portion (53) of the bottom lip (51) makes no contact with the radial shoulder (11) when the piston (50) is in its dispensing position, so that no axial force is exerted on the active portion (53).

6 Claims, 2 Drawing Sheets

FLUID DISPENSER PUMP

CROSS REFERENCE TO RELATED APPLICATION

This application claims the benefit under 35 U.S.C. §119 (e) of pending U.S. provisional patent application Ser. No. 60/387,431, filed Jun. 11, 2002, and priority under 35 U.S.C. §119(a)–(d) of French patent application No. FR-02.04811, filed Apr. 17, 2002.

TECHNICAL FIELD

The present invention relates to a manually-actuated fluid dispenser pump and to a fluid dispenser device including such a pump.

BACKGROUND OF THE INVENTION

In known manner, a pump generally includes a pump body in which a piston is mounted to slide between a rest position and a dispensing position, said piston being moved by the user into its dispensing position in order to dispense the fluid contained in said pump, e.g. in a pump chamber. In conventional manner, the pump is provided with means for defining the rest position of the piston, and with means for defining the dispensing position of said piston. Such means are generally in the form of abutments that define the end positions for the piston. It is known that the abutment defining the dispensing position can be implemented by means of a shoulder in the pump body, so that, when the piston comes into abutment against said shoulder, it is no longer possible to move the piston any further relative to the pump body, thereby defining the actuating end position or dispensing position of the piston.

Unfortunately, such a configuration suffers from a drawback. Each time the pump is actuated, the sealing lip of the piston, and in particular the active portion of the sealing lip, i.e. the portion that forms the leaktight contact between the lip and the pump body, comes into abutment against the radial shoulder, so that the active portion is subjected to axial forces or stresses. After the pump has been actuated several times, that can cause the sealing lip of the piston, and in particular its active sealing portion, to be damaged or deformed, which can give rise to a deterioration in the performance of the pump. Similarly, while the pump is being assembled, it is frequent for the piston to be moved into its dispensing position by the assembly machine. That can occur relatively roughly, and in any event much harder than when the pump is used by the user. In which case, the bottom sealing lip comes into abutment quite roughly against the radial shoulder of the body of the pump while the pump is being assembled. That can cause the sealing lip of the piston to be degraded or damaged on assembly of the pump.

BRIEF SUMMARY OF THE INVENTION

An object of the present invention is to provide a fluid dispenser pump that does not suffer from the above-mentioned drawbacks.

An object of the present invention is thus to provide a fluid dispenser pump that protects the piston, thereby avoiding any deterioration in the performance of the pump, and thereby increasing the life span of said pump.

An object of the present invention is also to provide such a fluid dispenser pump that is simple and inexpensive to manufacture and to assemble.

The present invention thus provides a manually-actuated fluid dispenser pump including a pump body and a piston mounted to slide in leaktight manner in said pump body between a rest position and a dispensing position, said piston being provided with at least a bottom sealing lip in leaktight contact with said pump body, said pump body being provided with an inwardly-extending radial shoulder co-operating with said bottom lip of the piston to form an abutment for said piston, and to define its dispensing position, said pump being characterized in that said pump body is provided with an axial annular setback at said radial shoulder so that the active sealing portion of the bottom lip makes no contact with said radial shoulder when the piston is in its dispensing position, so that no axial force is exerted on said active portion.

Advantageously, the bottom axial edge of the bottom lip of the piston is slanting, so that, when the piston is in the dispensing position, the non-active portion of the bottom edge is in abutting contact with said radial shoulder of the pump body, while the active sealing portion extends inside said annular setback.

The present invention also provides a fluid dispenser device including a pump as defined above.

BRIEF DESCRIPTION OF THE DRAWINGS

Other characteristics and advantages of the present invention will appear more clearly on reading the following detailed description of an embodiment of it, given with reference to the accompanying drawings, in which.

DETAILED DESCRIPTION

Figure 1:
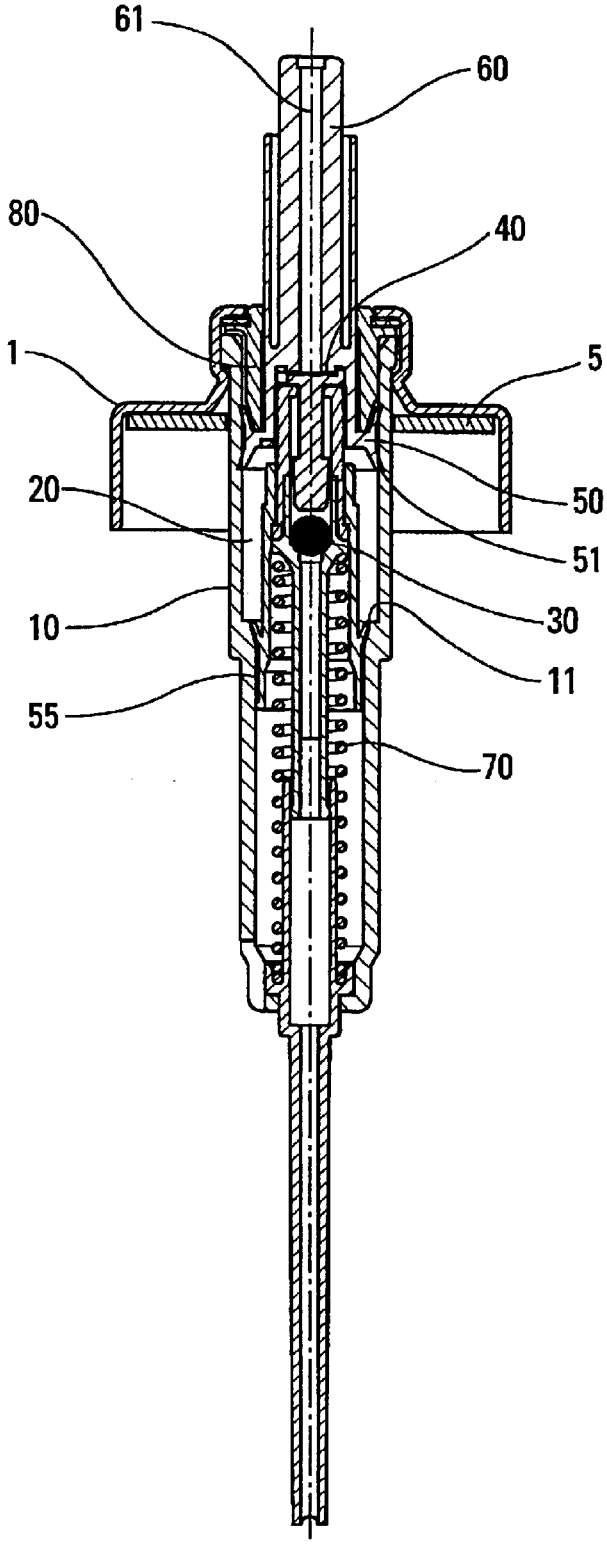
FIG. 1 is a diagrammatic section view of a fluid dispenser pump to which the present invention is adapted.

FIG. 1 diagrammatically shows a fluid dispenser pump to which the present invention may apply. However, it is to be understood that the present invention is not limited to the pump shown in FIG. 1, but rather it is applicable to any fluid dispenser pump in which a piston is mounted to slide in a pump body, and in which the actuating end position or dispensing position of the piston is defined by an abutment member co-operating with the sealing lip of the piston.

The pump shown in FIG. 1 includes a pump body 10 in which a first piston 50 is mounted to slide. The first piston is connected, preferably in integral manner, to an advantageously hollow actuating rod 60 incorporating an expulsion channel 61. The pump of the example shown in FIG. 1 further includes a second piston 55 which is mounted to slide in a small-diameter portion of the pump body. A pump chamber 20 is defined between the two pistons 50 and 55, and between an inlet valve 30 and an outlet valve 40. When the pump is actuated, the second piston 55 moves faster than the first piston 50 because of the differences in diameter, and the second piston 55 is adapted to open the outlet valve 40 mechanically when the piston 50 reaches the end of its actuating stroke. A ferrule 80 is further fitted into the top edge of the pump body 10 to define the rest position for the piston 50, and the pump shown may be assembled to a reservoir (not shown) by means of a fixing ring 1 which may be of any type, and in particular screw-fastenable, crimpable, or snap-fastenable. In known manner, a neck gasket 5 is generally interposed between the fixing ring 1 and the top edge of the reservoir (not shown). A spring 70 is adapted to return the pump to its rest position automatically after each occasion on which it is actuated.

Figure 2:
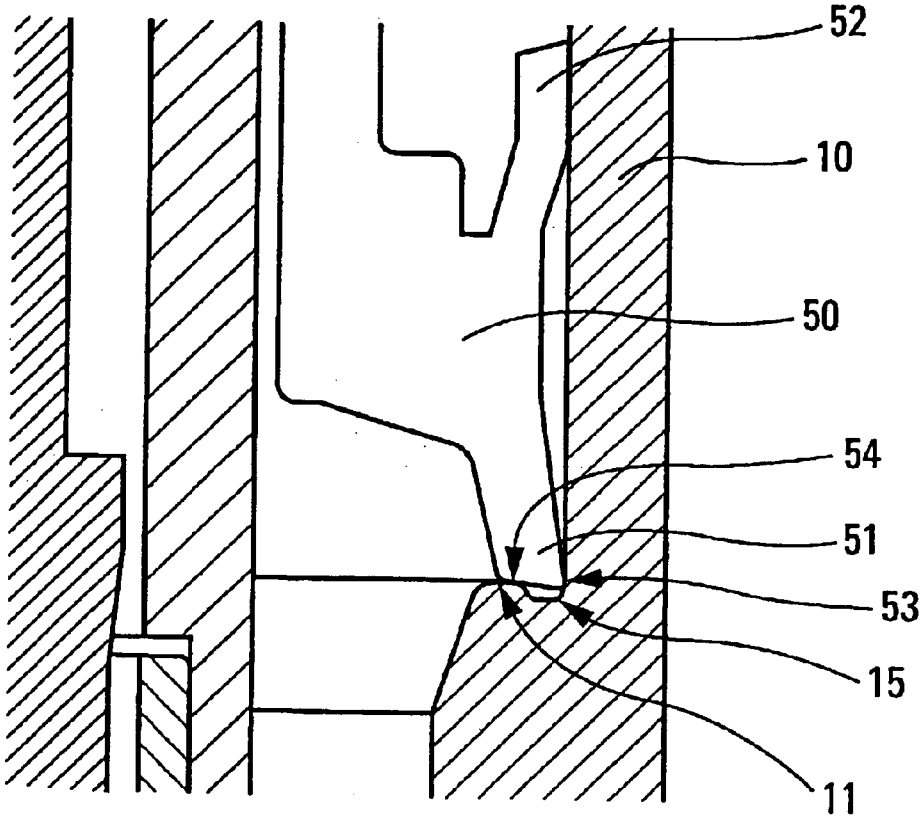
FIG. 2 is a diagrammatic view on an enlarged scale of a portion of FIG. 1, showing an advantageous embodiment of the present invention.

FIG. 2 shows the subject matter of the present invention. It should be noted that FIG. 2 is a very diagrammatic view, in which certain shapes or deformations have been exaggerated to simplify it.

In the invention, the pump body 10 is provided with an inwardly-extending radial shoulder 11 that defines the dispensing position of the piston 50. To avoid any damage being done to the bottom sealing lip 51 of the piston 50 and more particularly to the active sealing portion 53 of this bottom sealing lip 51, the pump body is provided with an axial annular setback 15. Thus, when the piston 50 is in the dispensing position, as shown in FIG. 2, the active sealing portion 53 of the bottom sealing lip 51 is not in contact with the radial shoulder 11, but rather it extends inside said axial annular setback 15, so that no axial stress or force is exerted on said active portion 53. Said active portion is thus neither deformed nor damaged when the piston reaches the dispensing position 50. This applies both while the pump is being assembled, and also each time the pump is actuated.

As shown diagrammatically in FIG. 2, the bottom edge 54 of the bottom sealing lip 51 of the piston 50 may be slanting so that the non-active portion of the bottom edge 54 is in abutting contact with said radial shoulder 11 in said dispensing position, while the active sealing portion 53 is not in contact with said radial shoulder and extends inside said axial setback 15. The radial dimension and/or the depth of said annular setback 15 may be adapted to the particular shape of the bottom edge 54 of the bottom sealing lip 51 of the piston 50, provided that, in the abutment position, the active portion 53, i.e. the portion performing the sealing, does not come into contact with the bottom of said axial setback 15.

The present invention thus makes it possible to avoid deterioration of the performance of the pump, and thus to increase the life span of the pump by removing any risk of the bottom sealing lip 51 of the piston 50 being damaged or deformed, in particular at its active sealing portion 53.

Although the present invention is described with reference to a particular embodiment of it, it should be understood that the person skilled in the art may make any modifications to it without going beyond the ambit of the present invention as defined by the accompanying claims.

What is claimed is:

1. A manually-actuated fluid dispenser pump including a pump body (10) and a piston (50) mounted to slide in leaktight manner in said pump body (10) between a rest position and a dispensing position, said piston (50) being provided with at least a bottom sealing lip (51) in leaktight contact with said pump body (10), said pump body (10) being provided with an inwardly-extending radial shoulder (11) co-operating with said bottom sealing lip (51) of the piston (50) to form an abutment for said piston (50), and to define its dispensing position, said pump being characterized in that said pump body (10) is provided with an axial annular setback (15) at said radial shoulder (11) so that an active sealing portion (53) of the bottom lip (51) makes no contact with said radial shoulder (11) when the piston (50) is in its dispensing position, so that no axial force is exerted on said active portion (53); and wherein in which a bottom axial edge (54) of the bottom sealing lip (51) of the piston (50) is slanting, so that, when the piston (50) is in the dispensing position, a non-active portion of the bottom edge (54) is in abutting contact with said radial shoulder (11) of the pump body (10), while the active sealing portion (53) extends inside said annular setback (15).

2. A fluid dispenser device, characterized in that it includes a pump according to claim 1.

3. A fluid dispenser pump, comprising;

a pump body; and a piston slidably mounted in the pump body between a first position and a second position; and wherein the piston comprises a sealing lip in leaktight contact with the pump body, the sealing lip comprising a bottom axial edge with an active sealing portion and a non-active portion, the bottom axial edge slants relative to a radial direction of the piston;

wherein the pump body comprising an inwardly-extending shoulder co-operating with the sealing lip as an abutment for the piston;

wherein the pump body comprises an axial setback at the shoulder so that the active sealing portion of the sealing lip makes no contact with the shoulder when the piston abuts the shoulder so that no axial force is exerted on the active sealing portion; and wherein, when the piston abuts the shoulder, the non-active portion abuts the shoulder while the active sealing portion extends within the setback.

4. The fluid dispenser pump according to claim 3, wherein the pump is a manually actuated pump.

5. The fluid dispenser pump according to claim 3, wherein the shoulder and set-back extend around the inner circumference of a wall of the pump and the setback is annular.

6. A fluid dispenser device comprising a pump according to claim 3.

* * * * *